US007755586B2

(12) United States Patent
Asada et al.

(10) Patent No.: US 7,755,586 B2
(45) Date of Patent: Jul. 13, 2010

(54) CIRCUITRY APPARATUS AND METHOD FOR COMPENSATING FOR DEFECTS IN A DISPLAY DEVICE

(75) Inventors: Tetsuo Asada, Takatsuki (JP); Kazuyoshi Nishi, Mukou (JP)

(73) Assignee: Panasonic Corporation, Osaka (JP)

( * ) Notice: Subject to any disclaimer, the term of this patent is extended or adjusted under 35 U.S.C. 154(b) by 855 days.

(21) Appl. No.: 11/438,283

(22) Filed: May 23, 2006

(65) Prior Publication Data

US 2006/0282569 A1 Dec. 14, 2006

(30) Foreign Application Priority Data

May 23, 2005 (JP) ..... 2005-149064

(51) Int. Cl.
*G09G 3/36* (2006.01)

(52) U.S. Cl. ..... 345/93; 349/54; 349/192

(58) Field of Classification Search ..... 345/93
See application file for complete search history.

(56) References Cited

U.S. PATENT DOCUMENTS 5,132,819 A 7/1992 Noriyama et al.
5,691,786 A * 11/1997 Nakai ..... 349/39
5,796,449 A * 8/1998 Song ..... 349/54
5,852,482 A * 12/1998 Kim ..... 349/46
5,956,008 A * 9/1999 Kawasaki et al. ..... 345/93
5,977,563 A * 11/1999 Kubo et al. ..... 257/72
5,995,178 A * 11/1999 Fujikawa et al. ..... 349/55
6,040,845 A * 3/2000 Melo et al. ..... 345/520
6,100,948 A * 8/2000 Kim et al. ..... 349/39
6,518,945 B1 * 2/2003 Pinkham ..... 345/92
6,525,705 B1 * 2/2003 Ishii et al. ..... 345/87
6,639,634 B1 * 10/2003 Zhang et al. ..... 349/54
6,680,770 B1 * 1/2004 Nagase ..... 349/139
6,697,037 B1 * 2/2004 Alt et al. ..... 345/93
6,717,648 B2 * 4/2004 Tsukao ..... 349/192
6,727,880 B2 * 4/2004 Lee ..... 345/98
6,816,143 B1 * 11/2004 Lambert ..... 345/93
6,977,635 B2 * 12/2005 Ogawa et al. ..... 345/93
7,034,903 B2 * 4/2006 Lee ..... 349/40
7,098,989 B2 * 8/2006 Wu ..... 349/192
7,224,338 B2 * 5/2007 Yamada ..... 345/89
7,245,690 B2 * 7/2007 Mutaguchi ..... 377/64
7,280,090 B2 * 10/2007 Keeney et al. ..... 345/93
7,436,381 B2 * 10/2008 Kim et al. ..... 345/87
2001/0009411 A1 * 7/2001 Kusanagi ..... 345/93

(Continued)

FOREIGN PATENT DOCUMENTS

JP 08-171081 A 7/1996

(Continued)

*Primary Examiner*—Amare Mengistu
*Assistant Examiner*—Gene W Lee
(74) *Attorney, Agent, or Firm*—McDermott Will & Emery LLP

(57) ABSTRACT

A display device according to the present invention comprises a buffer provided in association with each wiring constituting a group of wirings serving as signal lines of a display panel in order to drive the corresponding wiring, a preliminary wiring preliminarily provided for the wiring under a generation of a defect, a preliminary buffer provided in association with the preliminary wiring in order to drive the preliminary wiring, and a charge distributor for performing charge distribution between the wirings and the preliminary wiring.

7 Claims, 12 Drawing Sheets

U.S. PATENT DOCUMENTS

| | | | | |
|---|---|---|---|---|
| 2002/0113766 | A1* | 8/2002 | Keeney et al. | 345/93 |
| 2002/0118316 | A1 | 8/2002 | Yang | |
| 2005/0110738 | A1* | 5/2005 | Kim et al. | 345/100 |
| 2006/0125754 | A1* | 6/2006 | Rao et al. | 345/93 |

FOREIGN PATENT DOCUMENTS

| | | | |
|---|---|---|---|
| JP | 11-052928 | A | 2/1999 |
| JP | 2004-163912 | A | 6/2004 |

* cited by examiner

CIRCUITRY APPARATUS AND METHOD FOR COMPENSATING FOR DEFECTS IN A DISPLAY DEVICE

BACKGROUND OF THE INVENTION

1. Field of the Invention

The present invention relates to a display device, more particularly to a display device having a large screen and capable of repairing a disconnection defect of a wiring to drive a display.

2. Description of the Related Art

In a display device in which pixel electrodes are arranged in a matrix shape, a line width between the wirings formed on a substrate is narrowed based on a higher-definition, of a display panel and a routing length of the wirings formed on the substrate is extended on the display panel as a screen size is increased.

When a disconnection defect is generated in the wiring in the display device, it is not possible to drive the display device to display a pixel at a position distant from a part of the disconnection defect in a direction where a signal is transmitted, which significantly deteriorates a display quality. As a conventionally known construction proposed for dealing with the problem, an example of which is recited in No. H08-171081 of the Publication of the Unexamined Japanese Patent Applications, a preliminary wiring and a preliminary buffer are used to repair a problem (voltage drop) due to the disconnection defect generated in the wiring on the substrate so that the voltage drop is compensated. As the screen of the display panel has a larger size, however, a routing length of the preliminary wiring is increased in the foregoing construction. As a result, a load of the preliminary wiring used for the repair is larger than that of the wiring.

Another conventionally known construction capable of obtaining a display state substantially equal to a display state obtained in the case of normally-routed wirings by solving a driving performance shortage of the preliminary buffer is recited, for example, in No. H11-52928 of the Publication of the Unexamined Japanese Patent Applications.

Based on the foregoing conventional technologies, a charge distributor is installed in the display device as a recent trend in order to reduce power consumption of the display device, an example of which is recited No. 2004-163912 of the Publication of the Unexamined Japanese Patent Applications. According to the construction recited in the publication, the power consumption is reduced in such a manner that charges stored in vertical lines of the display panel are reutilized through changeover of a switch. However, the charge distributing operation is not carried out with respect to the load of the wiring repaired by the preliminary buffer via the preliminary wiring, which is not enough to reduce the power consumption.

SUMMARY OF THE INVENTION

Therefore, a main object of the present invention is to provide a display device in which a charge distributing operation is also done by a preliminary buffer so that reduction of power consumption is advanced.

In order to achieve the foregoing object, a display device according to the present invention comprises:

a buffer provided in association with each wiring constructing a group of wirings serving as signal lines of a display panel in order to drive the corresponding wiring;

a preliminary wiring preliminarily provided for the wiring caused a defect;

a preliminary buffer provided in association with the preliminary wiring in order to drive the preliminary wiring; and a charge distributor for performing charge distribution between the wirings and the preliminary wiring.

According to the foregoing construction, the charge distributing operation is performed for a load of the wiring repaired via the preliminary wiring provided to repair the disconnection. As a result, power consumption is further reduced.

It is preferable in the charge distributor to short-circuit (i.e., to directly connect) the outputs of the respective buffers to each other, and also short-circuit the outputs of the buffers and an output of the preliminary buffer to each other in the charge distributing operation in a state in which the preliminary buffer is used.

In the charge distributor, it is preferable to short-circuit only the output of the buffers to each other in the charge distributing operation in a state in which the preliminary buffer is not used.

According to the foregoing construction, the charge distributing operation between the preliminary buffer and the buffers can be stopped when the disconnection is not repaired, which controls any unnecessary potential variation in the preliminary wiring.

It is preferable in the charge distributor to control the output and input of the preliminary buffer to be in the short-circuit state in the charge distributing operation in the state that the preliminary buffer is not used.

According to the foregoing construction, the charge distributing operation for the preliminary buffer when the disconnection is not repaired is limitedly performed between the output and input of the preliminary buffer, which controls any unnecessary potential variation in the preliminary wiring.

It is preferable that the charge distributor stops power supply to the preliminary buffer during the charge distributing operation.

According to the foregoing construction, an idling current supply to the preliminary buffer can be halted during the charge distributing operation, which further reduces the power consumption.

In the foregoing construction, it is preferable that the charge distributor starts the power supply to the preliminary buffer prior to a timing of ending the charge distributing operation. Thereby, the preliminary buffer can be restarted before the termination of the charge distributing operation. As a result, the display operation after the completion of the charge distributing operation can be stabilized.

According to the display device of the present invention, a liquid crystal display device in which the disconnection defect can be repaired is capable of the charge distributing operation including the load of the wiring repaired via the preliminary wiring. As a result, any charge generated in the display device can be maximally utilized, which further contributes to the reduction of the power consumption.

Thus, the display device according to the present invention, which can obtain a maximal effect from the charge distributing operation, is very effective when used as the liquid crystal display device. The display device is also applicable to an organic EL display device, a PDP device and the like.

BRIEF DESCRIPTION OF THE DRAWINGS

These and other objects as well as advantages of the invention will become clear by the following description of preferred embodiments of the invention. A number of benefits not recited in this specification will come to the attention of the skilled in the art upon the implementation of the present invention.

DETAILED DESCRIPTION OF THE INVENTION

Figure 1:
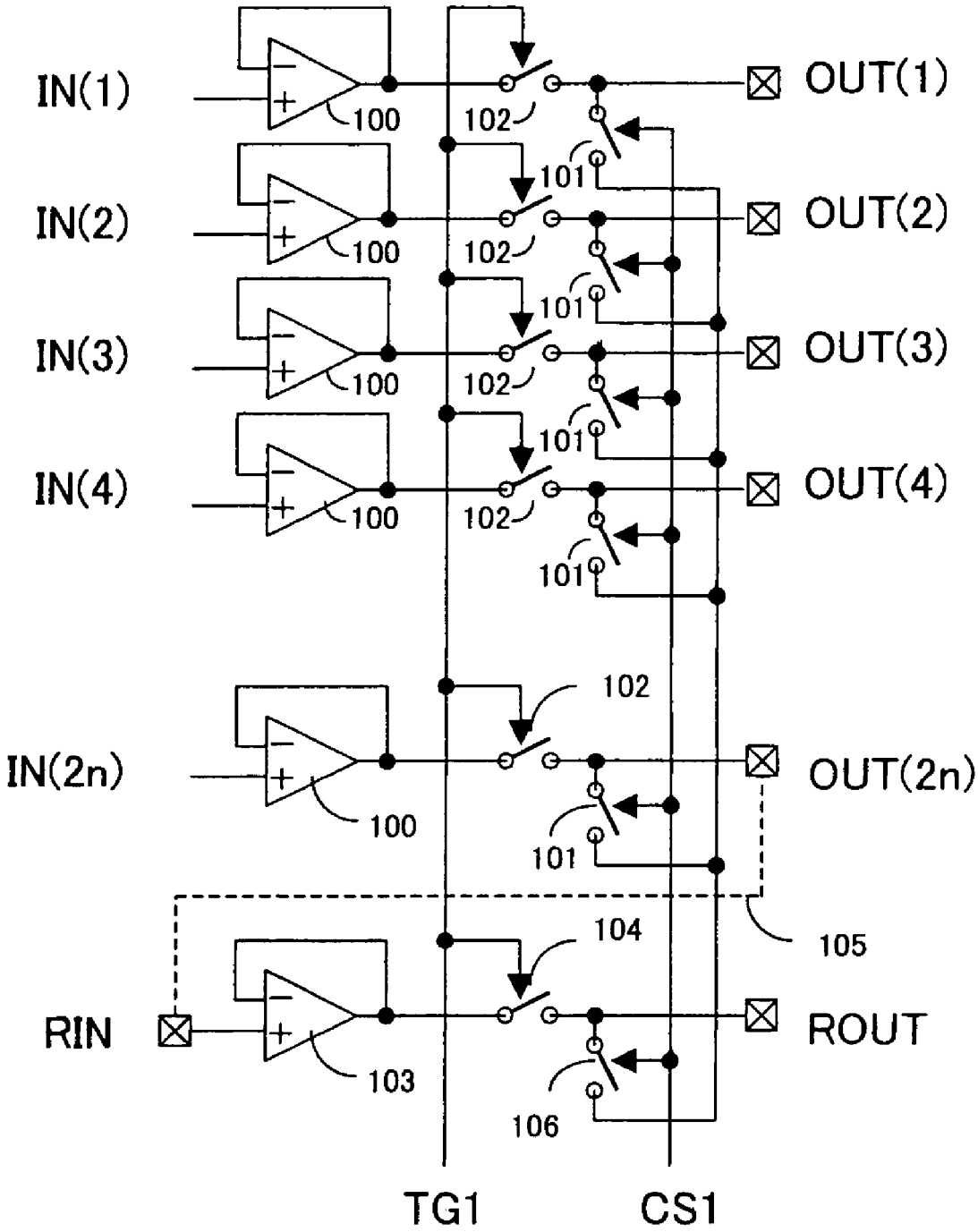
FIG. 1 shows a construction of a display device according to a preferred embodiment 1 of the present invention.

Hereinafter, preferred embodiments of the present invention are described referring to the drawings. In the preferred embodiments described below, the present invention is described referring to a liquid crystal display device having 2*n* number (2 is an integer) of output terminals.

Figure 11:
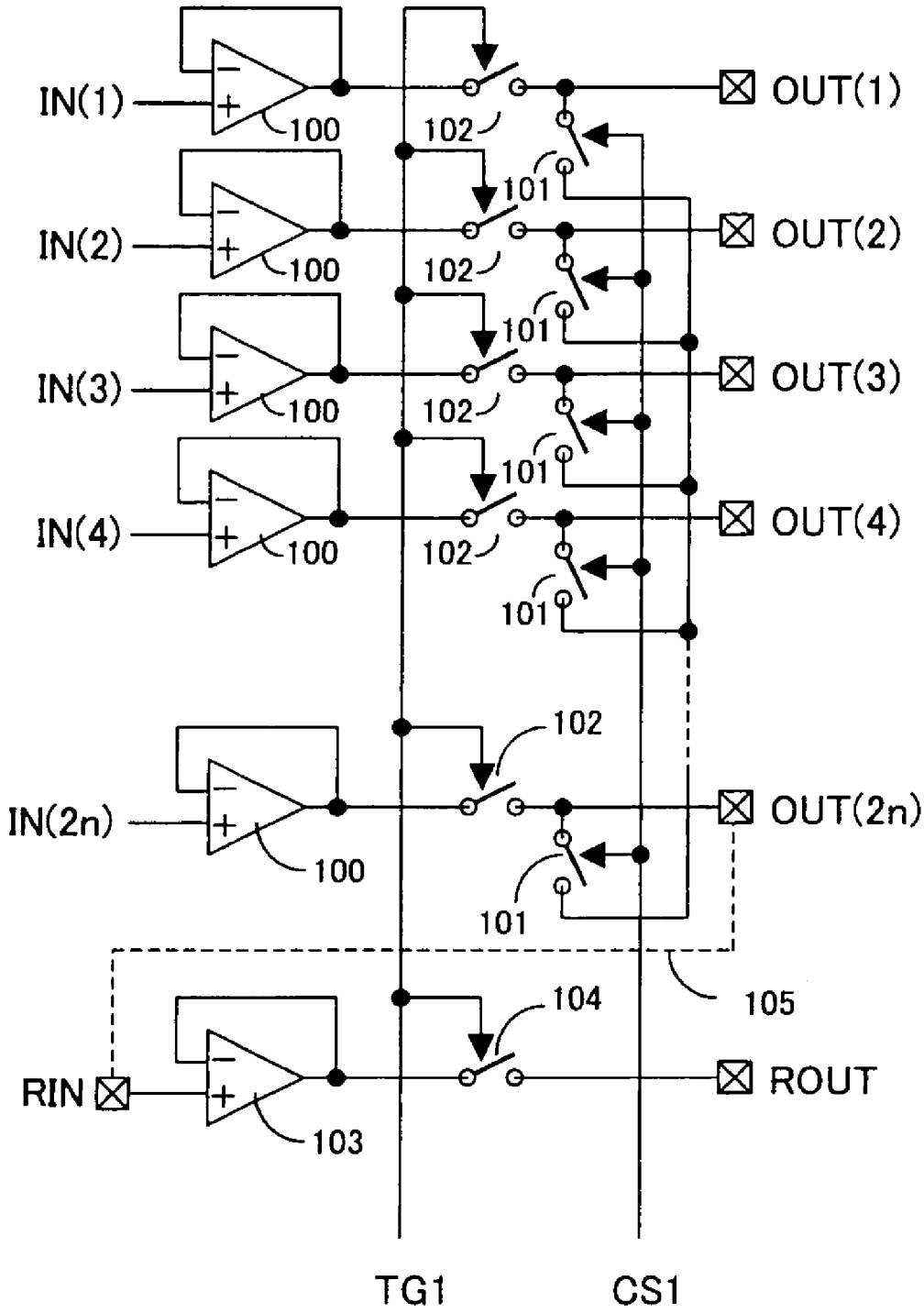
FIG. 11 shows a basic construction of a display device according to the present invention.

First, a basic construction of a liquid crystal display device provided with a charge distributor is described referring to FIG. 11. The display device comprises a group of wiring-driving buffers 100, a group of switches 101 for short-circuiting outputs of the buffers 100 to one another, a group of switches 102 for turning on and off the outputs of the buffers 100, a preliminary buffer 103 for repairing a disconnection defect, a switch 104 for turning on and off an output of the preliminary buffer 103, and a connection wiring 105 for connecting an output terminal OUT (2*n*) and an input terminal RIN to each other.

The buffers 100 constituting the group of buffers 100 are provided for each wiring consisting of a group of wirings serving as signal lines of a liquid crystal panel, and each of the buffers 100 drives the corresponding wiring. The preliminary buffer 103 is provided in association with a preliminary wiring preliminarily provided for any wiring under a generation of a defect such as the disconnection defect. The preliminary buffer 103 drives the corresponding preliminary wiring.

In the drawing, reference symbols IN (1)-IN (2*n*) respectively denote input terminals of the buffers 100, RIN denotes an input terminal of the preliminary buffer 103, OUT (1)-OUT (2*n*) respectively denote output terminals of the buffers 100, ROUT denotes an output terminal of the preliminary buffer 103, TG1 denotes a control signal for controlling ON and OFF of the group of switches 102 and the switch 104, and CS1 denotes a control signal for controlling ON and OFF of the group of switches 101. The control signals TG1 and CS1 are outputted from a display controller (CPU or the like) not shown.

In the description below, assuming that the disconnection defect is present in the wiring connecting the output terminal OUT (2*n*) and the signal line serving as the scanning line, a problem resulting from the disconnection defect (voltage drop or the like) is compensated in such a manner that the output terminal OUT (2*n*) and the input terminal RIN are connected via the connection wiring 105.

Figure 12:
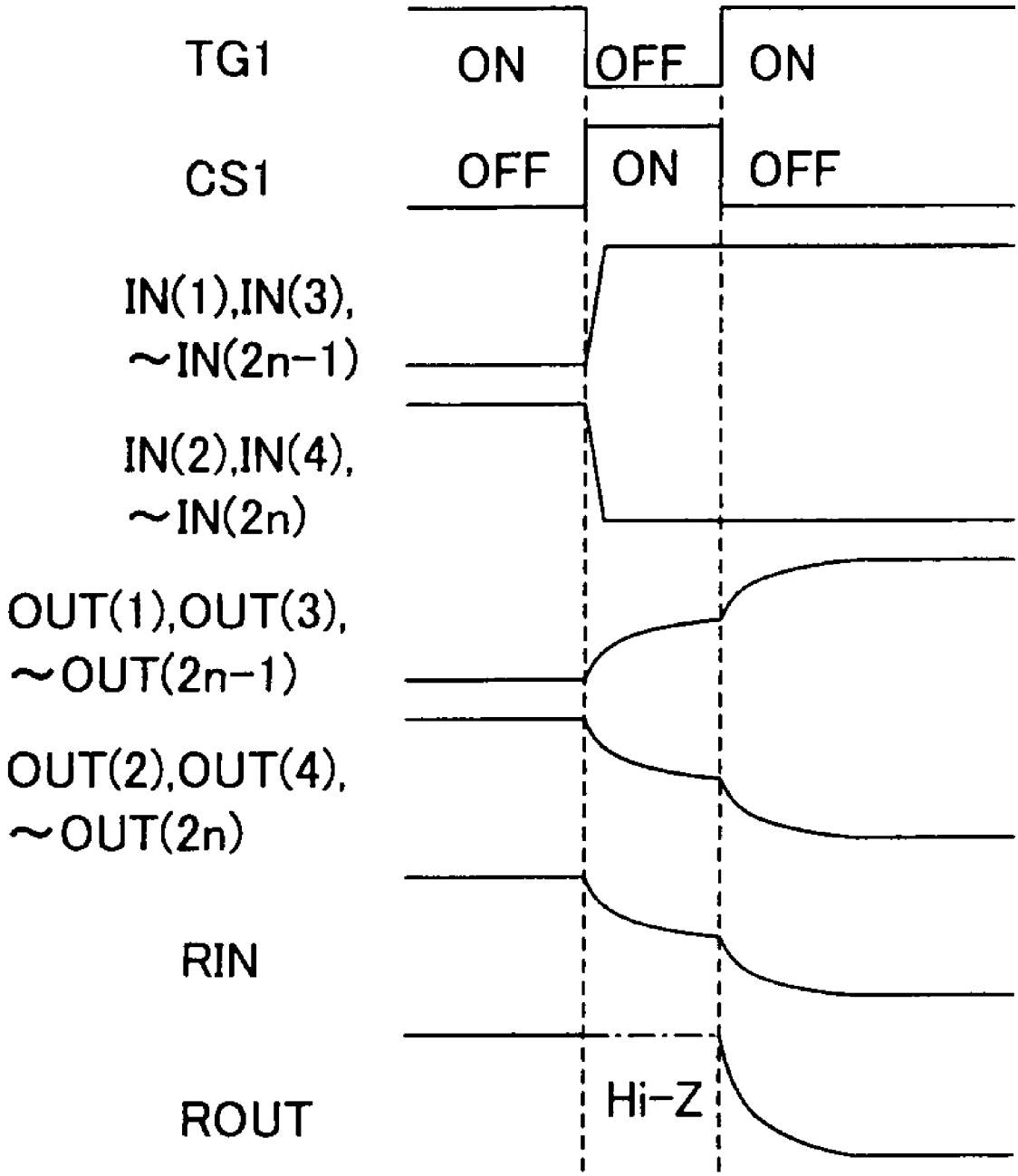
FIG. 12 is a timing chart of a basic operation of the display device according to the present invention.

In the charge distributor, the outputs of the wiring-driving buffers 100 are short-circuited to by a switching action of the switches 101 so that the charge of each wiring is collected. Below is given a description of an operation of the charge distributor referring to a timing chart shown in FIG. 12.

First, the switches 102 and 104 are turned on by the control signal TG1, and the switches 101 are turned off by the control signal CS1. In this state, a high-gradation side voltage is outputted from the odd-number output terminals OUT (1) and (3)-(2*n*−1) of the buffers 100, while a low-gradation side voltage is outputted from the even-number output terminals OUT (2) and (4)-(2*n*) of the buffers 100 and the output terminal ROUT of the preliminary buffer 103. Next, the switches 102 and 104 are turned off by the control signal TG, and the switches 101 are turned on by the control signal CS. Then, the odd-number output terminals OUT (1) and (3)-(2*n*−1 ) and the even-number output terminals OUT (2) and (4)-(2*n*) are also short-circuited. Accordingly, the charges stored in the respective buffers 100 are redistributed to result in intermediate voltage. However, the charge distributing operation is not applied to a load of the wiring repaired by the preliminary buffer 103, therefore it is not enough to reduce the power consumption.

Preferred Embodiment 1

FIG. 1 shows a schematic construction of a liquid crystal display device according to a preferred embodiment 1 of the present invention. Any component of the liquid crystal display device shown in FIG. 1, which is the same as that of the liquid crystal display device shown in FIG. 11, is provided with the same reference numeral and not described in detail again.

As shown in FIG. 1, a charge distributor of the liquid crystal display device according to the preferred embodiment 1 is different from the basic construction described earlier at a point that a switch 106 is provided. The switch 106 is a switch for short-circuiting the output of the preliminary buffer 103 to the outputs of the group of buffers 100. The switch 106 is turned on and off by the control signal CS1 in a manner similar to the group of switches 101. In the present preferred embodiment, the switches 101 constitute a first switch, and the switch 106 constitutes a second switch.

Figure 2:
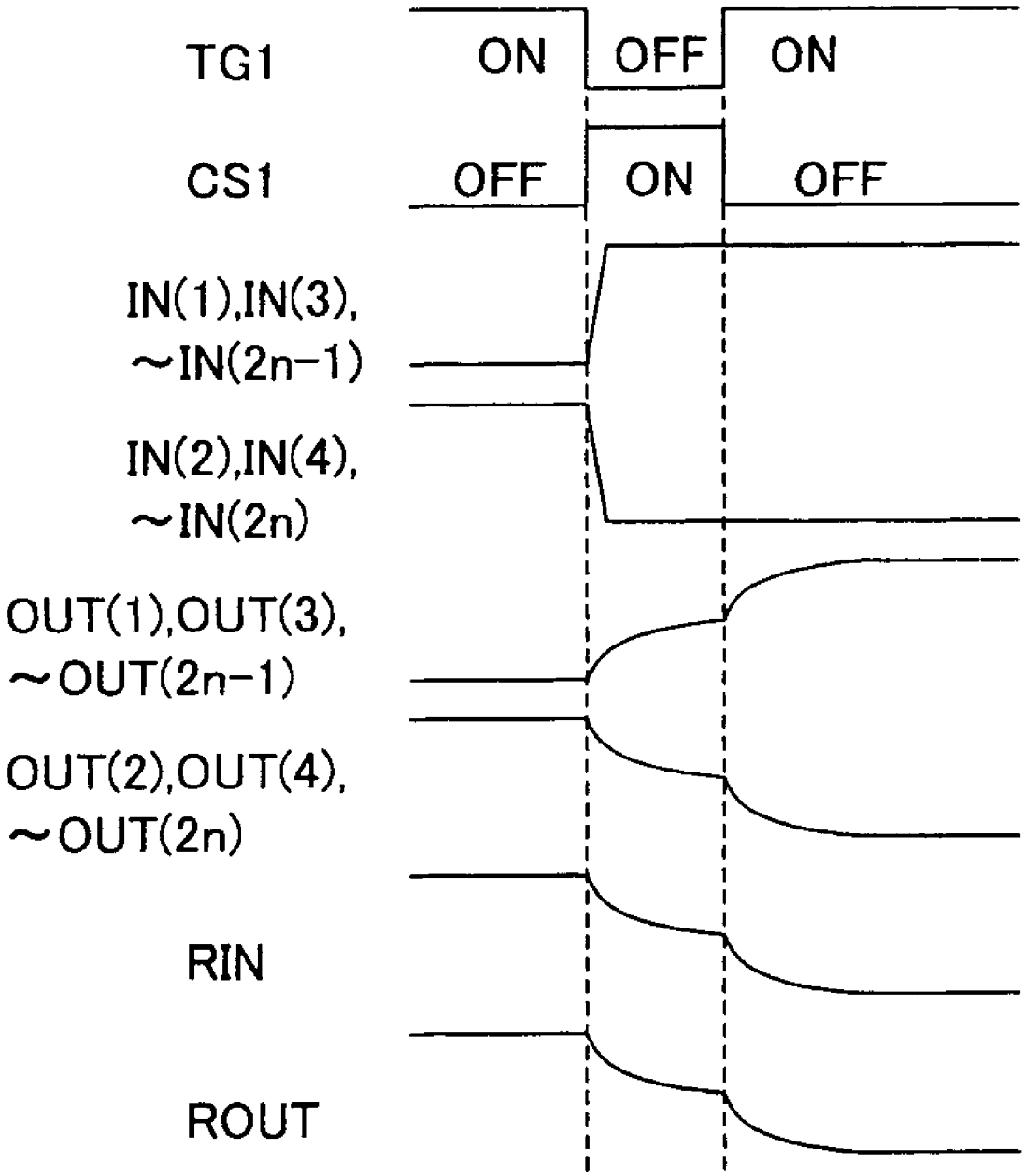
FIG. 2 is a timing chart of an operation of the display device according to the preferred embodiment 1.

An operation of the liquid crystal display device thus constituted is described referring to a timing chart shown in FIG. 2. In this specification, an operation according to the present invention is described referring to an example wherein a state in which the low-gradation side voltage is outputted from the odd-number output terminals OUT (1) and (3)-(2*n*−1) and the high-gradation side voltage is outputted from the even-number output terminals OUT (2) and (4)-(2*n*) (hereinafter, referred to as a first state) shifts to a state in which the high-gradation side voltage is outputted from the odd-number output terminals OUT (1) and (3)-(2*n*−1) and the low-gradation side voltage is outputted from the even-number output terminals OUT (2) and (4)-(2*n*) (hereinafter, referred to as a second state).

In the present preferred embodiment, the output terminal of the disconnected part (output terminal OUT (2*n*) in FIG. 2) and the input terminal RIN of the preliminary buffer 103 are connected via the connection wiring 105. After the foregoing pre-processing is executed, the following operation is executed.

First State

In the first state, the signal states of the control signals TG1 and CS1 are respectively set so that the control signal TG1 is High and the control signal CS1 is Low. Then, the switches 102 and 104 are turned on, while the switches 101 and 106 are turned off. In this state, the low-gradation side voltage is outputted from the odd-number output terminals OUT (1) and (3)-(2*n*−1), the high-gradation side voltage is outputted from the even-number output terminals OUT (2) and (4)-(2*n*), and the high-gradation side voltage is outputted from the output terminal ROUT of the preliminary buffer 103.

Intermediate State During Transition from First State to Second State

Next, the signal states of the control signals TG1 and CS1 are respectively set so that the control signal TG1 is Low and the control signal CS1 is High. Then, the switches 102 and 104 are turned off, while the switches 101 and 106 are turned on. Thereby, the odd-number output terminals OUT (1) and (3)-(2*n*−1), the even-number output terminals (2) and (4)-(2*n*) and the output terminal ROUT of the preliminary buffer 103 are short-circuited to one another, and the charge distributing operation is then applied. As a result, the output voltages of these output terminals result in the intermediate voltages thereof. As shown in FIG. 2, the output of the preliminary buffer 103 is additionally subjected to the charge distributing operation by the function of the switch 106.

Second State

Then, the signal states of the control signals TG1 and CS1 are respectively set so that the control signal TG1 is High and the control signal CS1 is Low. Then, the switches 102 and 104 are turned on, while the switches 101 and 106 are turned off. In this state, the high-gradation side voltage is outputted from the odd-number output terminals OUT (1) and (3)-(2*n*−1), the low-gradation side voltage is outputted from the even-number output terminals OUT (2) and (4)-(2*n*), and the low-gradation side voltage is outputted from the output terminal ROUT of the preliminary buffer 103.

The charge of the load of the wiring repaired via the connection wiring 105 is reutilized because the output of the preliminary buffer 103 is thus additionally subjected to the charge distributing operation. Therefore, the power consumption during the transition from the first state to the second state is further reduced.

N-type MOS transistors or P-type MOS transistors functioning similar to the switches 101, 102, 104 and 106 according to the present preferred embodiment may be used instead of these switches, a similar effect can be obtained in this case.

Second Preferred Embodiment 2

Figure 3:
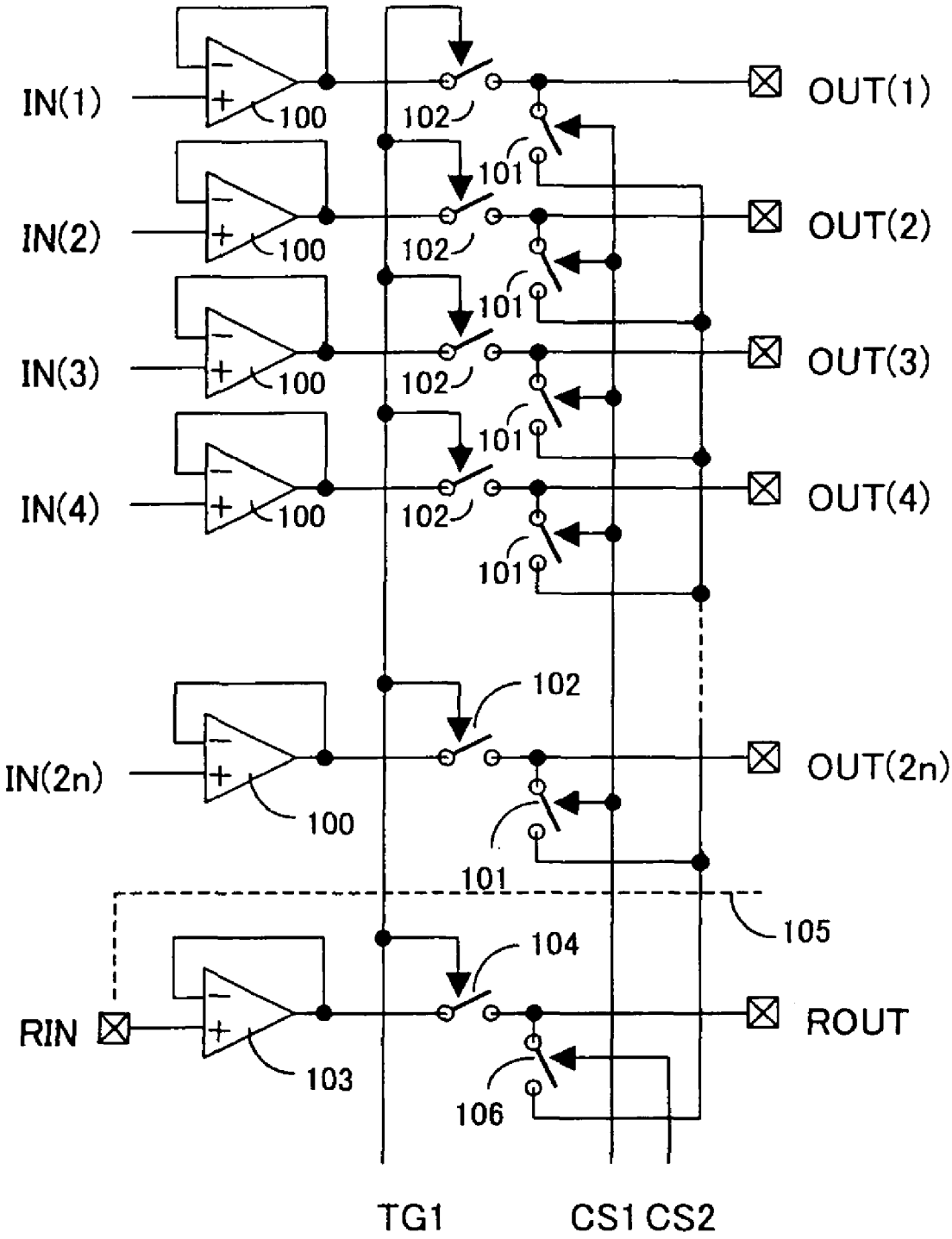
FIG. 3 shows a construction of a display device according to a preferred embodiment 2 of the present invention.

FIG. 3 shows a schematic construction of a liquid crystal display device according to a preferred embodiment 2 of the present invention. The component of the liquid crystal display device shown in FIG. 3, which is the same as that of the liquid crystal display device shown in FIG. 1, is given the same reference numeral and not described in detail again.

As shown in FIG. 3, the liquid crystal display device according to the preferred embodiment 2 is different from that of the preferred embodiment 1 at a point that a control signal CS2 for controlling the switch 106 is provided separately from the control signal CS1 for controlling the group of switches 101. The control signal CS2 is outputted from the display controller (CPU or the like) not shown in a manner similar to the control signals TG1 and CS2.

Figure 4:
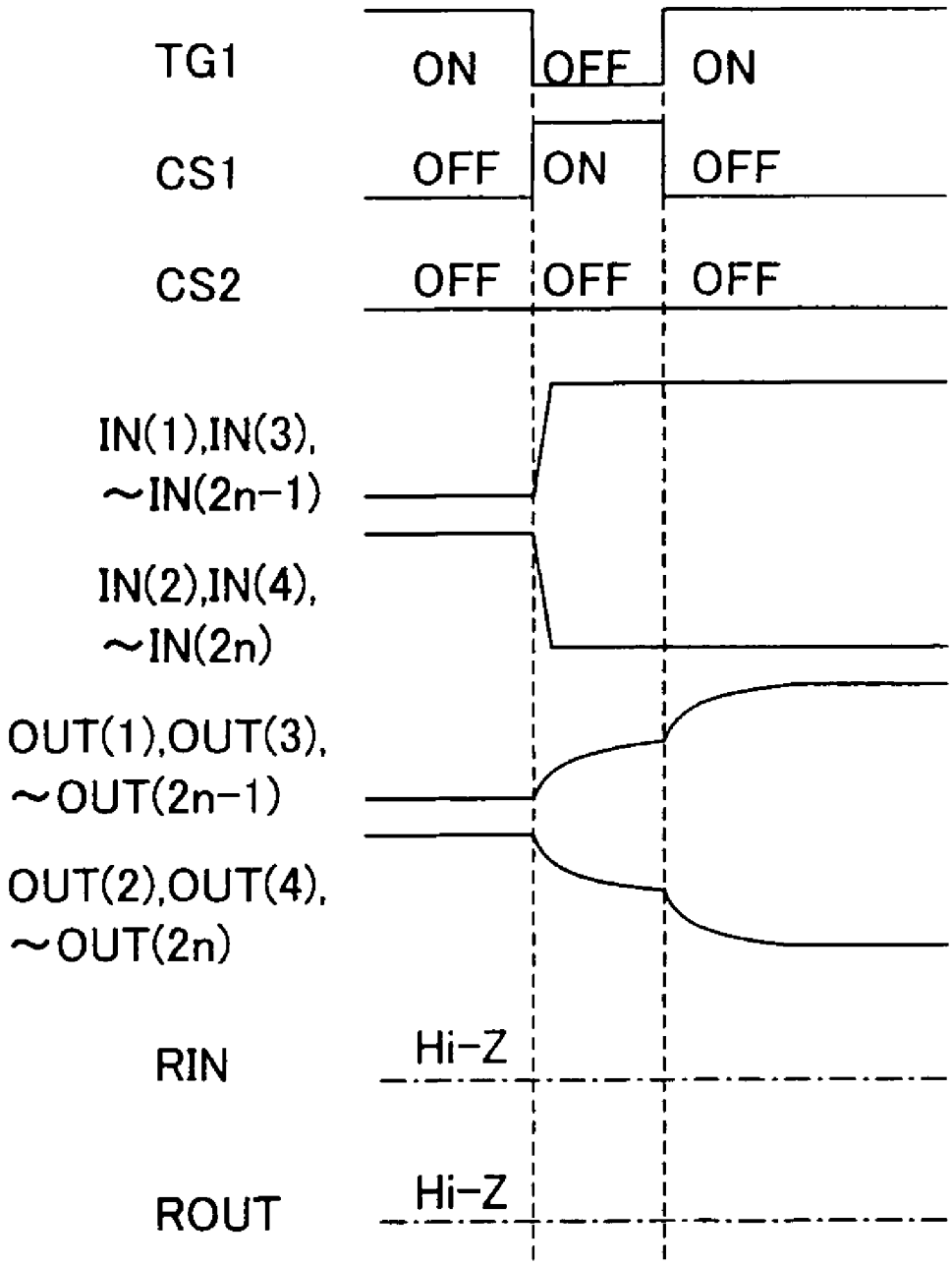
FIG. 4 is a timing chart of an operation of the display device according to the preferred embodiment 2.

An operation of the liquid crystal display device thus constituted is described referring to a timing chart shown in FIG. 4. FIG. 4 shows a timing chart in the case of not repairing the disconnection.

First is described the case where the disconnection is not repaired. In this case, the output terminal of the disconnected part (output terminal OUT (2*n*) in the preferred embodiment 1) and the input terminal RIN of the preliminary buffer 103 are not connected via the connection wiring 105.

First State

In the first state, the signal states of the control signals TG1, CS1 and CS2 are respectively set so that the control signal TG1 is High, the control signal CS1 is Low and the control signal CS2 is Low. Then, the switches 102 and 104 are turned on, while the switches 101 and 106 are turned off. In this state, the low-gradation side voltage is outputted from the odd-number output terminals OUT (1) and (3)-(2*n*−1), and the high-gradation side voltage is outputted from the even-number output terminals OUT (2) and (4)-(2*n*).

Intermediate State During from First State to Second State

Next, the signal states of the control signals TG1, CS1 and CS2 are respectively set so that the control signal TG1 is Low, the control signal CS1 is High and the control signal CS2 is Low. Then, the switches 102 and 104 are turned off, the switches 101 are turned on, and the switch 106 is turned off. Accordingly, the odd-number output terminals OUT (1) and (3)-(2*n*−1) and the even-number output terminals OUT (2) and (4)-(2*n*) are short-circuited to each other, and the charge distributing operation is then applied. As a result, the output voltages of these output terminals result in the intermediate voltages thereof. As shown in FIG. 4, the output of the preliminary buffer 103 is not subject to the charge distributing operation because the switch 106 is in the OFF state at the time. Therefore, any potential variation unnecessary for the preliminary wiring to repair the disconnection is not generated.

Second State

The signal states of the control signals TG1, CS1 and CS2 are respectively set so that the control signal TG1 is High, the control signal CS1 is Low and the control signal CS2 is Low. Then, the switches 102 and 104 are turned on, while the switches 101 and 106 are turned off. In this state, the high-gradation side voltage is outputted from the odd-number output terminals OUT (1) and (3)-(2*n*−1), and the low-gradation side voltage is outputted from the even-number output terminals OUT (2) and (4)-(2*n*).

In the case of repairing the disconnection (in the case of connecting the output terminal of the disconnected part and the input terminal RIN of the preliminary buffer 103 via the connection wiring 105), a processing similar to that of the preferred embodiment 1 is basically executed. In such a case, the control signal CS2 is given the same value as that of the control signal CS1. In such a manner, the charge of the wiring load is reutilized in the state in which the output of the preliminary buffer 103 is also subject to the charge distributing operation. As a result, the reduction of the power consumption is further advanced.

Preferred Embodiment 3

Figure 5:
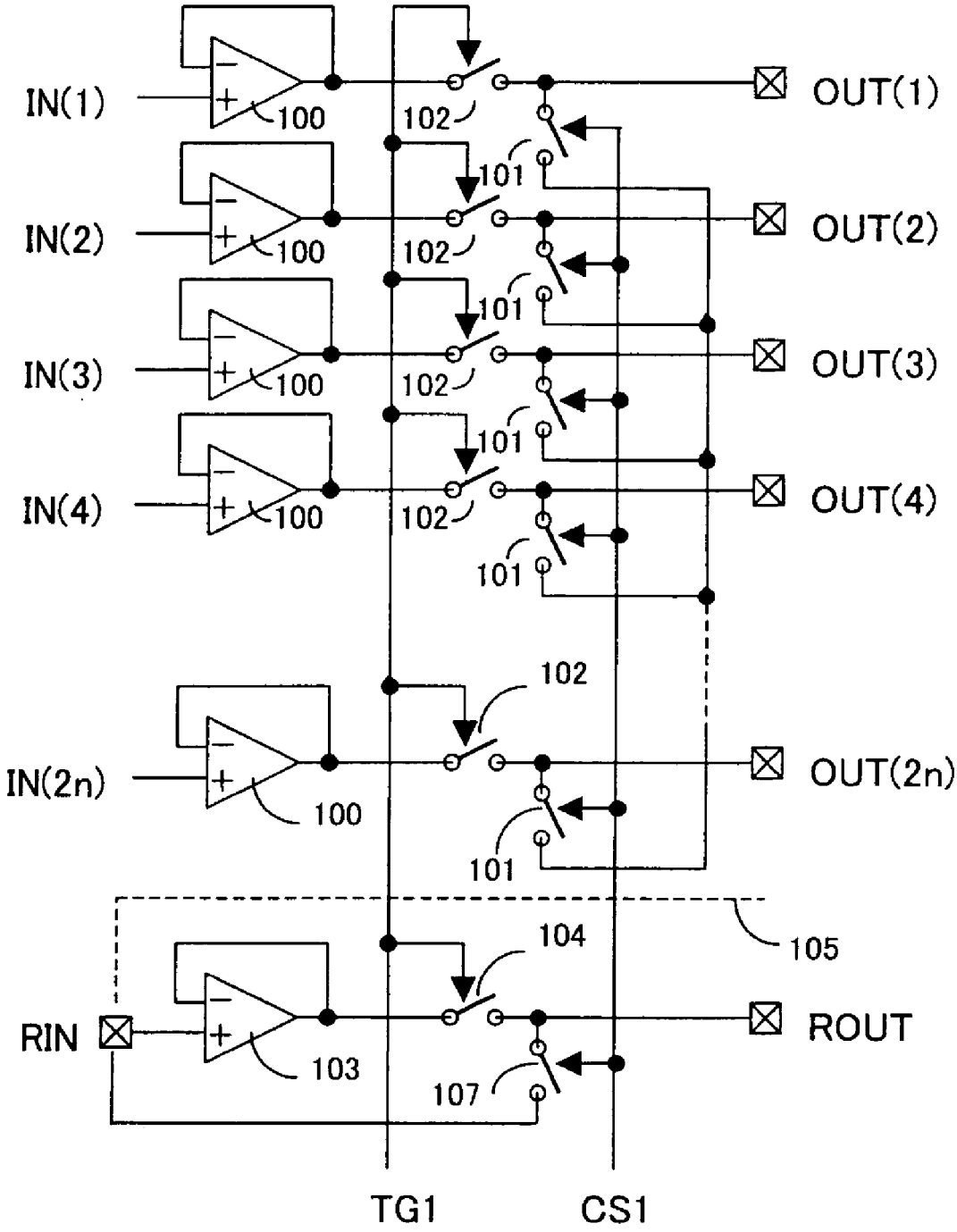
FIG. 5 shows a construction of a display device according to a preferred embodiment 3 of the present invention.

FIG. 5 shows a schematic construction of a liquid crystal display device according to a preferred embodiment 3 of the present invention. Any component of the liquid crystal display device shown in FIG. 5, which is the same as that of the liquid crystal display device shown in FIG. 1, is given the same reference numeral and not described in detail again.

As shown in FIG. 5, the liquid crystal display device according to the preferred embodiment 3 is different from that of the preferred embodiment 1 at a point that a switch 107 is provided in place of the switch 106. The switch 107 short-circuits the input terminal RIN of the preliminary buffer 103 and the output terminal ROUT to each other based on the control signal CS1. In the present preferred embodiment, the switch 107 constitutes a third switch.

Figure 6:
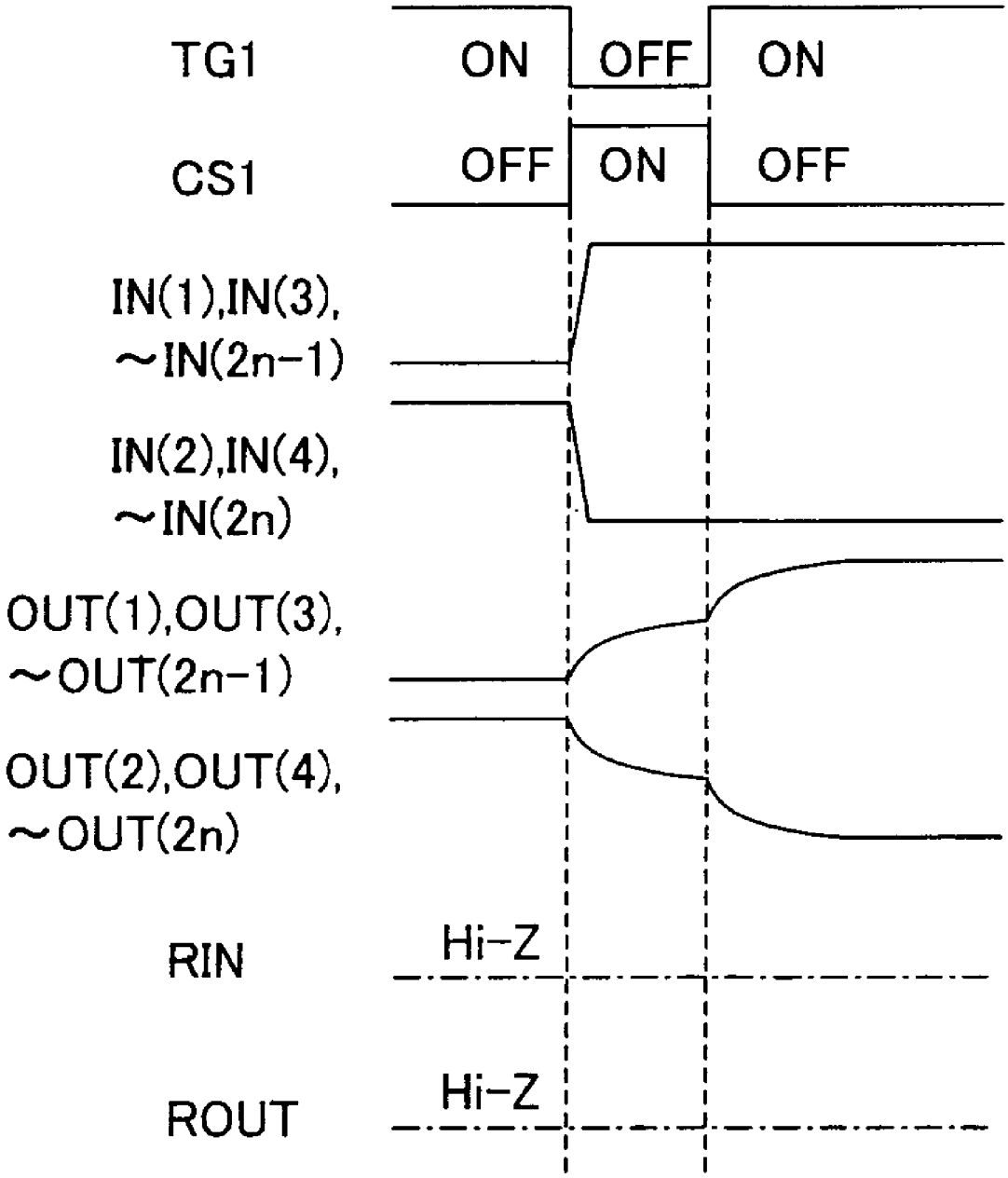
FIG. 6 is a timing chart of an operation of the display device according to the preferred embodiment 3.

An operation of the liquid crystal display device thus constituted is described referring to a timing chart shown in FIG. 6. FIG. 6 shows the timing chart in the case of not repairing the disconnection.

Below is described the case where the disconnection is not repaired. In this case, the output terminal of the disconnected part (for example, output terminal OUT (2*n*)) and the input terminal RIN of the preliminary buffer 103 are not connected via the connection wiring 105.

First State

In the first state, the signal states of the control signals TG1 and CS1 are respectively set so that the control signal TG1 is High and the control signal CS1 is Low. Then, the switches 102 and 104 are turned on, while the switches 101 and 107 are turned off. In this state, the low-gradation side voltage is outputted from the odd-number output terminals OUT (1) and (3)-(2*n*−1), and the high-gradation side voltage is outputted from the even-number output terminals OUT (2) and (4)-(2*n*).

Intermediate State During Transition from First State to Second State

Next, the signal states of the control signals TG1 and CS1 are respectively set so that the control signal TG1 is Low and the control signal CS1 is High. Then, the switches 102 and 104 are turned off, the switches 101 are turned on, and the switch 107 is turned on. Accordingly, the odd-number output terminals OUT (1) and (3)-(2*n*−1) and the even-number output terminals OUT (2) and (4)-(2*n*) are short-circuited to each other, and the charge distributing operation is then applied. As a result, the output voltages of these output terminals result in the intermediate voltages thereof. The input terminal RIN and the output terminal ROUT of the preliminary buffer 103 are short-circuited to by the switch 107, while the output terminal of the disconnected part (for example, output terminal OUT (2*n*) or the like) and the input terminal RIN are not connected via the connection wiring 105. Therefore, the output of the preliminary buffer 103 is not subject to the charge distributing operation, and any unnecessary potential variation is prevented from generating between the output terminal of the disconnected part (for example, output terminal OUT (2*n*)) and the connection wiring 105.

Second State

The signal states of the control signals TG1 and CS1 are respectively set so that the control signal TG1 is High and the control signal CS1 is Low. Then, the switches 102 and 104 are turned on, while the switches 101 and 107 are turned off. In this state, the high-gradation side voltage is outputted from the odd-number output terminals OUT (1) and (3)-(2*n*−1), and the low-gradation side voltage is outputted from the even-number output terminals OUT (2) and (4)-(2*n*).

Next is described the case where the disconnection is repaired. First, the output terminal of the disconnected part (for example, output terminal OUT (2*n*)) and the input terminal RIN of the preliminary buffer 103 are connected via the connection wiring 105.

First State

In the first state, the signal states of the control signals TG1 and CS1 are respectively set so that the control signal TG1 is High and the control signal CS1 is Low. Then, the switches 102 and 104 are turned on, while the switches 101 and 107 are turned off. In this state, the low-gradation side voltage is outputted from the odd-number output terminals OUT (1) and (3)-(2*n*−1), the high-gradation side voltage is outputted from the even-number output terminals OUT (2) and (4)-(2*n*), and the high-gradation side voltage is outputted from the output terminal ROUT of the preliminary buffer 103.

Intermediate State During Transition from First State to Second State

Next, the signal states of the control signals TG1 and CS1 are respectively set so that the control signal TG1 is Low and the control signal CS1 is High. Then, the switches 102 and 104 are turned off, while the switches 101 and 107 are turned on. Accordingly, the odd-number output terminals OUT (1) and (3)-(2*n*−1), the even-number output terminals OUT (2) and (4)-(2*n*) and the output terminal ROUT of the preliminary buffer 103 are short-circuited to one another, and the charge distributing operation is then performed. As a result, the output voltages of these output terminals result in the intermediate voltages thereof The input terminal RIN and the output terminal ROUT of the preliminary buffer 103 are also short-circuited by the function of the switch 107, while the output terminal of the disconnected part (for example, output terminal OUT (2*n*) or the like) and the input terminal RIN are connected via the connection wiring 105. Therefore, the output of the preliminary buffer 103 is also subject to the charge distributing operation.

Second State

The signal states of the control signals TG1 and CS1 are respectively set that the control signal TG1 is High and the control signal CS1 is Low. Then, the switches 102 and 104 are turned on, while the switches 101 and 107 are turned off. Accordingly, the high-gradation side voltage is outputted from the odd-number output terminals OUT (1) and (3)-(2*n*−1), the low-gradation side voltage is outputted from the even-number output terminals OUT (2) and (4)-(2*n*), and the low-gradation side voltage is outputted from the output terminal ROUT of the preliminary buffer 103.

Because the output of the preliminary buffer 103 is also subject to the charge distributing operation, the charge of the load of the wiring repaired via the connection wiring 105 is reutilized. As a result, the power consumption can be further reduced.

Preferred Embodiment 4

Figure 7:
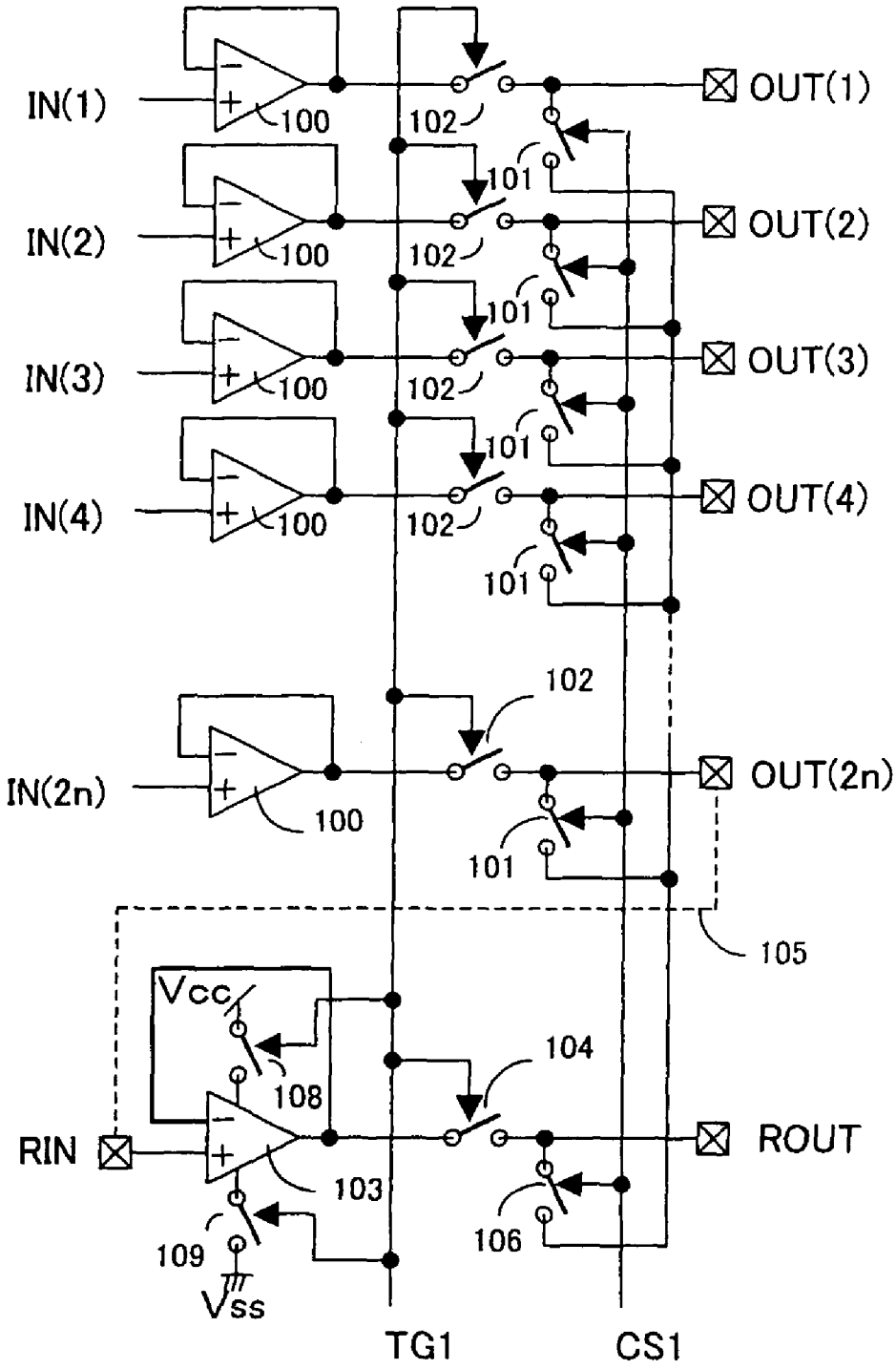
FIG. 7 shows a construction of a display device according to a preferred embodiment 4 of the present invention.

FIG. 7 shows a schematic construction of a liquid crystal display device according to a preferred embodiment 4 of the present invention. Any component of the liquid crystal display device shown in FIG. 7, which is the same as that of the liquid crystal display device shown in FIG. 1, is given the same reference numeral and not described in detail again.

As shown in FIG. 7, the liquid crystal display device according to the preferred embodiment 4 is different from that of the preferred embodiment 1 at a point that switches 108 and 109 are provided in addition to the switch 106. The switch 108 controls ON and OFF of connection between the preliminary buffer 103 and a power-supply voltage Vcc based on the control signal TG1. The switch 109 controls ON and OFF of connection between the preliminary buffer 103 and a ground voltage Vss based on the control signal TG1. In the present preferred embodiment, the switches 108 and 109 constitute a fourth switch.

Figure 8:
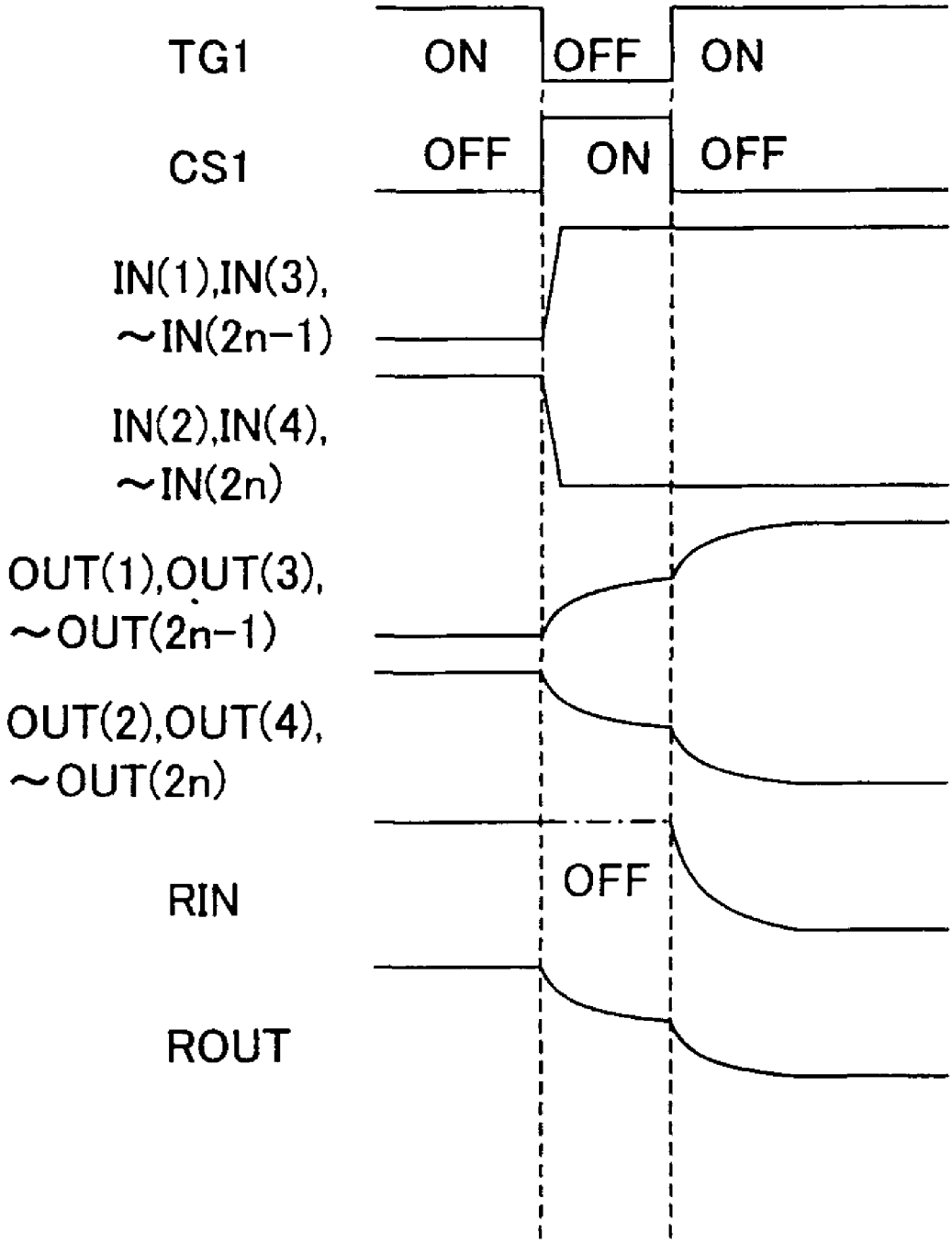
FIG. 8 is a timing chart of an operation of the display device according to the preferred embodiment 4.

An operation of the liquid crystal display device thus constituted is described referring to a timing chart shown in FIG. 8.

First is described the case where the disconnection is not repaired. In this case, the output terminal of the disconnected part (for example, output terminal OUT (2*n*)) and the input terminal RIN of the preliminary buffer 103 are not connected via the connection wiring 105.

First State

In the first state, the signal states of the control signals TG1 and CS1 are respectively set so that the control signal TG1 is High and the control signal CS1 is Low. Then, the switches 102, 104, 108 and 109 are turned on, while the switches 101 and 106 are turned off. In this state, the low-gradation side voltage is outputted from the odd-number output terminals OUT (1) and (3)-(2*n*−1), and the high-gradation side voltage is outputted from the even-number output terminals OUT (2) and (4)-(2*n*).

Intermediate State During Transition from First State to Second State

Next, the signal states of the control signals TG1 and CS1 are respectively set so that the control signal TG1 is Low and the control signal CS1 is High. Then, the switches 102, 104, 108 and 109 are turned off, the switches 101 are turned on, and the switch 106 is turned on. Accordingly, the odd-number output terminals OUT (1) and (3)-(2*n*−1) and the even-number output terminals OUT (2) and (4)-(2*n*) are short-circuited to each other, and the charge distributing operation is then performed. As a result, the output voltages of these output terminals result in the intermediate voltages thereof At the time, the preliminary buffer 103 is not power-supplied because the switches 108 and 109 are turned off. Therefore, the preliminary buffer 103 is in a non-drivable state.

Second State

The signal states of the control signals TG1 and CS1 are respectively set so that the control signal TG1 is High and the control signal CS1 is Low. Then, the switches 102, 104, 108 and 109 are turned on, while the switches 101 and 106 are turned off. In this state, the high-gradation side voltage is outputted from the odd-number output terminals OUT (1) and (3)-(2*n*−1) and the low-gradation side voltage is outputted from the even-number output terminals OUT (2) and (4)-(2*n*). At the time, the preliminary buffer 103 is power-supplied because the switches 108 and 109 are turned on. Therefore, the preliminary buffer 103 is in a drivable state.

Next is described the case where the disconnection is repaired. First, the output terminal of the disconnected part (for example, output terminal OUT (2*n*)) and the input terminal RIN of the preliminary buffer 103 are connected via the connection wiring 105. After the execution of the foregoing pre-processing, an operation described below is executed.

First State

In the first state, the signal states of the control signals TG1 and CS1 are respectively set so that the control signal TG1 is High and the control signal CS1 is Low. Then, the switches 102, 104, 108 and 109 are turned on, while the switches 101 and 106 are turned off. In this state, the low-gradation side voltage is outputted from the odd-number output terminals OUT (1) and (3)-(2*n*−1), the high-gradation side voltage is outputted from the even-number output terminals OUT (2) and (4)-(2*n*), and the high-gradation side voltage is outputted from the output terminal ROUT of the preliminary buffer 103.

Intermediate State During Transition from First State to Second State

Next, the signal states of the control signals TG1 and CS1 are respectively set so that the control signal TG1 is Low and the control signal CS1 is High. Then, the switches 102, 104, 108 and 109 are turned off, while the switches 101 and 106 are turned on. Accordingly, the odd-number output terminals OUT (1) and (3)-(2*n*−1), the even-number output terminals OUT (2) and (4)-(2*n*) and the output terminal ROUT of the preliminary buffer 103 are short-circuited to one another, and the charge distributing operation is then performed. As a result, the output voltages of these output terminals result in the intermediate voltages thereof. Then, the output of the preliminary buffer 103 is also added to an object of the charge distributing operation by the function of the switch 106.

At the time, the preliminary buffer 103 is not power-supplied because the switches 108 and 109 are turned off. Therefore, the preliminary buffer 103 is in the non-drivable state.

Second State

Next, the signal states of the control signals TG1 and CS1 are respectively set so that the control signal TG1 is High and the control signal CS1 is Low. Then, the switches 102, 104, 108 and 109 are turned on, while the switches 101 and 106 are turned off. In this state, the high-gradation side voltage is outputted from the odd-number output terminals OUT (1) and (3)-(2*n*−1), the low-gradation side voltage is outputted from the even-number output terminals OUT (2) and (4)-(2*n*), and the low-gradation side voltage is outputted from the output terminal ROUT of the preliminary buffer 103. At the time, the preliminary buffer 103 is power-supplied because the switches 108 and 109 are turned on. Therefore, the preliminary buffer 103 is in the drivable state.

Thus, the output of the preliminary buffer 103 is also added to an object of the charge distributing operation, and the charge of the load of the wiring repaired via the connection wiring 105 is reutilized. As a result, the reduction of the power consumption is further advanced.

Further, an idling current can be stopped because the preliminary buffer 103 is in the OFF state during the charge distributing operation, which contributes to the further reduction of the power consumption.

Preferred Embodiment 5

Figure 9:
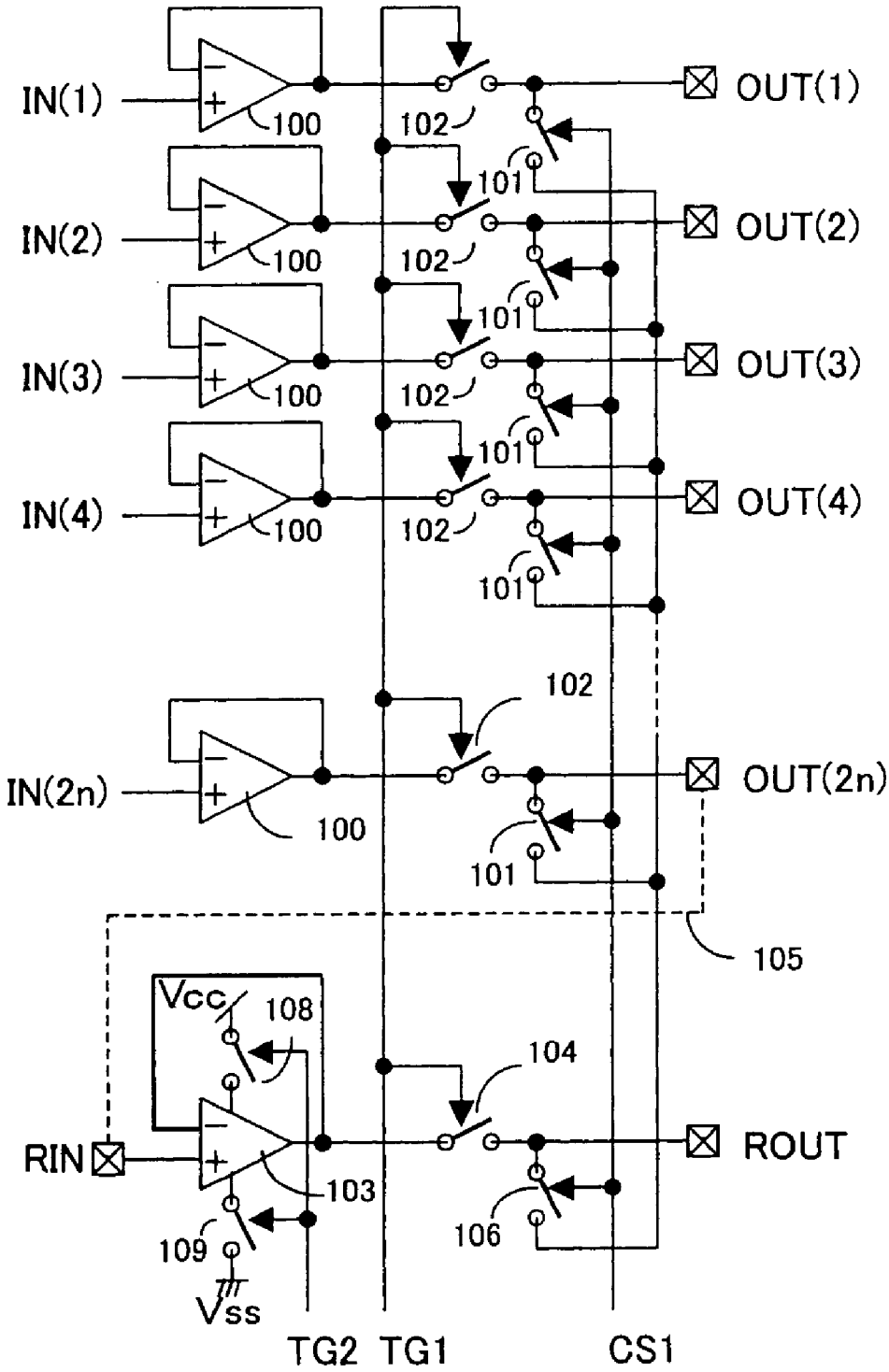
FIG. 9 shows a construction of a display device according to a preferred embodiment 5 of the present invention.

FIG. 9 shows a schematic construction of a liquid crystal display device according to a preferred embodiment 5 of the present invention. Any component of the liquid crystal display device shown in FIG. 9, which is the same as that of the liquid crystal display device according to the preferred embodiment 4 shown in FIG. 7, is given the same reference numeral and not described in detail again.

As shown in FIG. 9, the liquid crystal display device according to the preferred embodiment 5 is different from that of the preferred embodiment 4 at a point that the switches 108 and 109 are controlled by the control signal TG2.

Figure 10:
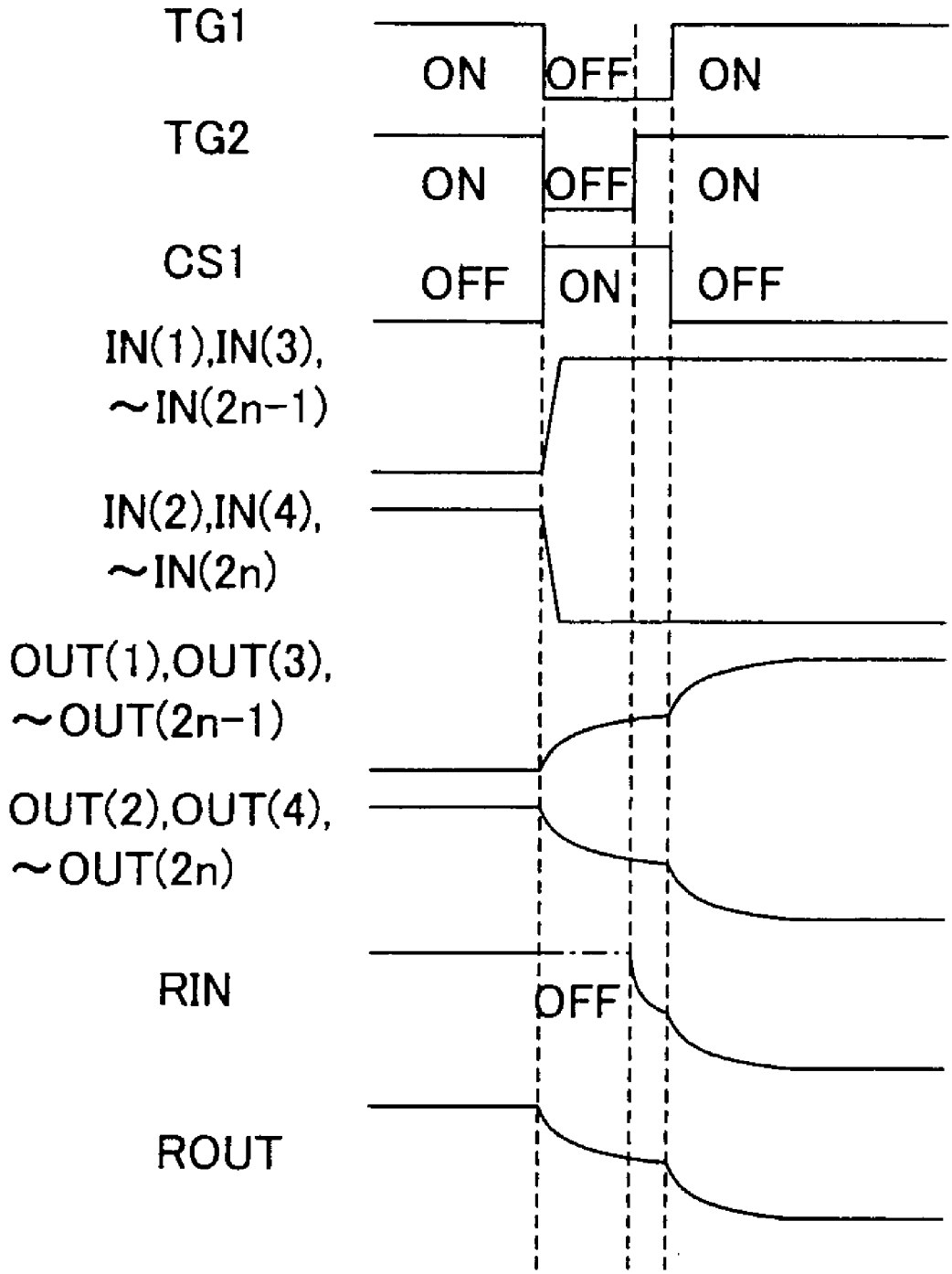
FIG. 10 is a timing chart of an operation of the display device according to the preferred embodiment 5.

An operation of the liquid crystal display device thus constituted is described referring to a timing chart shown in FIG. 10.

First is described the case where the disconnection is not repaired. In this case, the output terminal of the disconnected part (for example, output terminal OUT (2*n*)) and the input terminal RIN of the preliminary buffer 103 are not connected via the connection wiring 105.

First State

In the first state, the signal states of the control signals TG1, TG2 and CS1 are respectively set so that the control signal TG1 is High, the control signal TG2 is High and the control signal CS1 is Low. Then, the switches 102, 104, 108 and 109 are turned on, while the switches 101 and 106 are turned off. In this state, the low-gradation side voltage is outputted from the odd-number output terminals OUT (1) and (3)-(2*n*−1), and the high-gradation side voltage is outputted from the even-number output terminals OUT (2) and (4)-(2*n*).

First-Half Period of Intermediate State During from First State to Second State

Next, the signal states of the control signals TG1, TG2 and CS1 are respectively set so that the control signal TG1 is Low, the control signal TG2 is Low and the control signal CS1 is High. Then, the switches 102, 104, 108 and 109 are turned off, the switches 101 are turned on, and the switch 106 is turned on. Thereby, the odd-number output terminals OUT (1) and (3)-(2*n*−1) and the even-number output terminals (2) and (4)-(2*n*) are short-circuited to each other, and the charge distributing operation is then applied. As a result, the output voltages of these output terminals result in the intermediate voltages thereof.

At the time, the preliminary buffer 103 is not power-supplied because the switches 108 and 109 are turned off. Therefore, the preliminary buffer 103 is in the non-drivable state, which serves to further reduce the power consumption.

Latter-Half Period of Intermediate State Between First State and Second State

Immediately before the first state shifts to the second state, the signal states of the control signals TG1, TG2 and CS1 are respectively set so that the control signal TG1 is Low, the control signal TG2 is High and the control signal CS1 is High. Then, the switches 102 and 104 remain OFF, the switches 101 remain ON, and the switch 106 remains ON, while the switches 108 and 109 are switched from OFF to ON.

Accordingly, the power supply to the preliminary buffer 103 starts, and the preliminary buffer 103 returns to the drivable state in advance at a time point immediately before the shift to the second state.

Second State

Next, the signal states of the control signals TG1, TG2 and CS1 are respectively set so that the control signal TG1 is High, the control signal TG2 is High and the control signal CS1 is Low. Then, the switches 102 and 104, in addition to the switches 108 and 109, are turned on, while the switches 101 and 106 are turned off. In this state, the high-gradation side voltage is outputted from the odd-number output terminals OUT (1) and (3)-(2*n*−1), and the low-gradation side voltage is outputted from the even-number output terminals OUT (2) and (4)-(2*n*).

Next is described the case where the disconnection is repaired. In this case, first, the output terminal of the disconnected part (output terminal OUT (2*n*)) and the input terminal RIN of the preliminary buffer 103 are connected via the connection wiring 105. After the foregoing pre-processing is executed, the following operation is executed.

First State

In the first state, the signal states of the control signals TG1, TG2 and CS1 are respectively set so that the control signal TG1 is High, the control signal TG2 is High and the control signal CS1 is Low. Then, the switches 102, 104, 108 and 109 are turned on, while the switches 101 and 106 are turned off. In this state, the low-gradation side voltage is outputted from the odd-number output terminals OUT (1) and (3)-(2*n*−1), the high-gradation side voltage is outputted from the even-number output terminals OUT (2) and (4)-(2*n*), and the high-gradation side voltage is outputted from the output terminal ROUT of the preliminary buffer 103.

First-Half Period of Intermediate State During Transition from First State to Second State Next, the signal states of the control signals TG1, TG2 and CS1 are respectively set so that the control signal TG1 is Low, the control signal TG2 is Low and the control signal CS1 is High. Then, the switches 102, 104, 108 and 109 are turned off, the switches 101 are turned on, and the switch 106 is turned on. In this state, the odd-number output terminals OUT (1) and (3)-(2*n* −1) and the even-number output terminals OUT (2) and (4)-(2*n*) are short-circuited to each other, and the charge distributing operation is then performed. As a result, the output voltages of these output terminals result in the intermediate voltages thereof.

At the time, the output of the preliminary buffer 103 is added to an object of the charge distributing operation as by the function of the switch 106. Therefore, the charge of the load of the wiring repaired via the connection wiring 105 is reutilized. As a result, the power consumption is further reduced.

Further, the preliminary buffer 103 is not power-supplied because the switches 108 and 109 are turned off. The preliminary buffer 103 is therefore in the non-drivable state, which further advances the reduction of the power consumption.

Latter-Half Period of Intermediate State During Transition from First State to Second State Immediately before the first state shifts to the second state, the signal states of the control signals TG1, TG2 and CS1 are respectively set so that the control signal TG1 is Low, the control signal TG2 is High and the control signal CS1 is High. Then, the switches 102 and 104 remain OFF, the switches 101 remain ON, and the switch 106 remains ON, while the switches 108 and 109 are changed from OFF to ON.

Accordingly, the power supply to the preliminary buffer 103 starts, and the preliminary buffer 103 returns to the drivable state in advance at the time point immediately before the shift to the second state.

Second State

Next, the signal states of the control signals TG1, TG2 and CS1 are respectively set so that the control signal TG1 is High, the control signal TG2 is High and the control signal CS1 is Low. Then, the switches 102 and 104, in addition to the switches 108 and 109, are turned on, while the switches 101 and 106 are turned off. In this state, the high-gradation side voltage is outputted from the odd-number output terminals OUT (1) and (3)-(2*n*−1), and the low-gradation side voltage is outputted from the even-number output terminals OUT (2) and (4)-(2*n*).

As described, according to the present preferred embodiment, the preliminary buffer 103 is shifted from the ON state to the OFF state during the charge distributing operation, so that the supply of the idling current with respect to the preliminary buffer 103, which is unnecessary during the charge distributing operation, can be stopped. Thereby, the power consumption can be further reduced. Moreover, the operation of the preliminary buffer 103 after the completion of the charge distributing operation can be stabilized because the preliminary buffer 103 is returned to the ON state before the completion of the charge distributing operation.

While there has been described what is at present considered to be preferred embodiments of this invention, it will be understood that various modifications may be made therein, and it is intended to cover all such modifications as fall within the true spirit and scope of this invention in the appended claims.

What is claimed is:

1. A display device comprising:

buffers each of which is provided in association with each wiring constituting a group of wirings serving as signal lines of a display panel in order to drive the corresponding wiring;

a preliminary buffer provided to drive a preliminary wiring, an input terminal of the preliminary buffer being configured to be short-circuited to an output of the buffers which drives a defective wiring in a state in which the preliminary buffer is used; and a charge distributor for performing charge distribution between the wirings and the preliminary wiring, wherein:

the charge distributor short-circuits outputs of the respective buffers to each other and also short-circuits the outputs of the buffers and an output of the preliminary buffer to each other in the charge distributing operation in the state in which the preliminary buffer is used, and the charge distributor further short-circuits only the output of the buffers to each other in the charge distributing operation in a state in which the preliminary buffer is not used.

2. The display device according to claim 1, wherein the state in which the preliminary buffer is used means a state in which an output terminal of a buffer which drives the defective wiring and an input terminal of the preliminary buffer is connected to each other, and the state in which the preliminary buffer is not used means a state in which none of output terminals of the buffers and the input terminal of the preliminary buffer is connected to each other.

3. The display device according to claim 1, wherein the charge distributor comprises:

a first switch for controlling whether or not the outputs of the buffers are short-circuited to each other; and a second switch for controlling whether or not the output of the buffers and the output of the preliminary buffer are short-circuited to each other, wherein the charge distributor controls the first switch and the second switch to be closed in the charge distribution in the state in which the preliminary buffer is used, and the charge distributor controls only the first switch to be closed in the charge distribution in the state in which the preliminary buffer is not used.

4. The display device according to claim 1, wherein the charge distributor comprises a preliminary buffer control switch for controlling whether or not the input and the output of the preliminary buffer are short-circuited to, and the charge distributor closes the preliminary buffer control switch in the charge distribution operation in the state in which the preliminary buffer is not used.

5. The display device according to Claim 1, wherein the charge distributor halts power supply to the preliminary buffer during a charge distributing operation.

6. The display device according to claim 5, wherein the charge distributor comprises a power-supply control switch for controlling whether or not the preliminary buffer is power-supplied, and the charge distributor halts the power-supply control switch during the charge distribution operation.

7. The display device according to claim 5, wherein the charge distributor starts power supply to the preliminary buffer prior to a timing when the charge distributing operation is terminated.

* * * * *